US005832943A

United States Patent [19]

Johnson

[11] Patent Number: 5,832,943

[45] Date of Patent: Nov. 10, 1998

[54] PICNIC TABLE COVER

[76] Inventor: Edward Wayne Johnson, 6001 Westbrook Dr., New Carrollton, Md. 20784

[21] Appl. No.: 925,173

[22] Filed: Sep. 9, 1997

Related U.S. Application Data

[60] Provisional application No. 60/026,870 Oct. 3, 1996.

[51] Int. Cl. [6] ..... E04H 15/36

[52] U.S. Cl. ..... 135/124; 135/125

[58] Field of Search ..... 135/124, 125, 135/128, 138, 151, 157, 161, 119

[56] References Cited

U.S. PATENT DOCUMENTS

| | | | |
|---|---|---|---|
| D. 279,833 | 7/1985 | Eberle . | |
| D. 290,315 | 6/1987 | Swenson et al. . | |
| 2,357,056 | 8/1944 | Nelson | 135/125 X |
| 2,367,043 | 1/1945 | Nelson | 135/125 X |
| 3,051,185 | 8/1962 | Reynolds | 135/124 |
| 3,088,244 | 5/1963 | Commisso | 135/124 X |
| 3,221,756 | 12/1965 | Rupright . | |
| 3,233,618 | 2/1966 | Ferrier . | |
| 3,399,687 | 9/1968 | Frieder | 135/124 X |
| 3,417,764 | 12/1968 | Hemenway . | |
| 4,221,289 | 9/1980 | Domicent | 135/124 X |
| 4,627,363 | 12/1986 | Jones . | |
| 4,705,084 | 11/1987 | Rodebaugh et al. . | |
| 4,708,183 | 11/1987 | Figueroa . | |
| 4,709,718 | 12/1987 | Nichols | 135/125 |
| 4,883,001 | 11/1989 | Roth . | |
| 5,185,972 | 2/1993 | Markiewicz . | |
| 5,215,108 | 6/1993 | Sprague . | |
| 5,238,014 | 8/1993 | Cai | 135/124 X |
| 5,595,203 | 1/1997 | Espinosa | 135/124 |

FOREIGN PATENT DOCUMENTS

| | | | |
|---|---|---|---|
| 940286 | 12/1948 | France . | |
| 518557 | 12/1957 | Italy | 135/124 |
| 177592 | 12/1961 | Sweden | 135/124 |
| 2216850 | 10/1989 | United Kingdom . | |

*Primary Examiner*—Lanna Mai
*Attorney, Agent, or Firm*—Richard C. Litman

[57] ABSTRACT

A semicylindrical cover for a table, especially an outdoor picnic table, that may be placed over food and drink that is left on the table, for protecting the food and liquid refreshment while a family or other group temporarily leaves the table unattended. The cover will protect the food and drink from the heat of the sun, wind, rain, falling leaves, bird droppings, insects or other pests. The invention includes a rectangular main portion that is made of a flexible waterproof material. The main portion is supported over the table by rigid, semicircular ribs which maintain the main portion in a curved shape. Semicircular end portions are attached to the opposite ends of the main portion for protection at the ends of the picnic table. After positioning, the ends of clamps are passed through pairs of holes provided in the cover to clamp each side portion of the cover between a clamping member and a side of the picnic table.

8 Claims, 2 Drawing Sheets

PICNIC TABLE COVER

CROSS-REFERENCE TO RELATED APPLICATION

This application claims the benefit of U.S. Provisional Patent Application Ser. No. 60/026,870, filed Oct. 03, 1996.

BACKGROUND OF THE INVENTION

1. Field of the Invention

The present invention relates to a cover for a table, and especially for an outdoor picnic table, for protecting food and drinks from insects, pests, and the elements while a family or other group temporarily leaves the table unattended.

2. Description of the Prior Art

Food and drinks left on a picnic table easily become contaminated with dirt, debris, and bird droppings; infested by insects or other pests; and blown about by wind, rained upon, or overheated by the sun. The instant invention is a generally semicylindrical cover that is rolled open to go over the top of a picnic table for protecting the food and drinks while a family or other group temporarily leaves the table unattended. The invention also includes clamping members by which it is secured to the sides of the table. Although there are numerous previous inventions for covers for picnic and other tables, it will be seen that none are equivalent to the present invention.

U.S. Pat. No. 4,627,363, issued on Dec. 9, 1986, to Juliana C. Jones, discloses a table covering apparatus, with strips going under the table that are fastened to each other. U.S. Pat. No. 4,705,084, issued on Nov. 10, 1987, to Jimmy L. Rodebaugh and Onetta R. Rodebaugh, discloses a cover for an outdoor table, that is attached with straps going under the table, with hook and loop fasteners at the end of the straps, and separate covers for benches on its sides. U.S. Pat. No. 4,708,183, issued on Nov. 24, 1987, to Jose L. Figueroa, discloses a combination table cover and skirt retainer, wherein the skirt is retained by VELCRO (i.e., hook and loop fastener material). U.S. Pat. No. 4,883,001, issued on Nov. 28, 1989, to Alfred C. Roth, discloses a sheet plastic cover for a picnic table, which has channel-shaped side edges that slide onto the edges of the table, and is retained on the table by an adhesive or nails. The instant invention is distinguishable, in that it also covers food on the table, rather than directly covering the surface of the table. French Pat. No. 940,286, issued Dec. 8, 1948, to Francois Bonnet, discloses a table having special food compartments built thereinto, and having a cover that is slid over the edges of the table. However, unlike the present invention, the Bonnet invention is not designed to be used with conventional picnic tables.

U.S. Pat. No. Des. 279,833, issued on Jul. 30, 1985, to John J. Eberle, discloses a design for a portable canopy for a camp or picnic table. U.S. Pat. No. Des. 290,315, issued on Jun. 16, 1987, to Neil C. Swenson and Duain Swenson, discloses a design for a combined picnic table and canopy. U.S. Pat. No. 3,221,756 issued Dec. 7, 1965 to Bert Rupright discloses an awning assembly. U.S. Pat. No. 3,417,764 issued Dec. 24, 1968 to Earl Hemenway discloses a portable, adjustable awning device. U.S. Pat. No. 5,185,972 issued Feb. 16, 1993 to Richard Markiewicz discloses a modular canopy which can be selectively assembled to obtain various desired widths. U.S. Pat. No. 5,215,108 issued Jun. 1, 1993 to Sprague discloses a combination table and canopy apparatus. British Pat. No. 2,216,850A, issued on Oct. 18, 1989, to Clive Percival, discloses improvements in sun canopies for perambulators and pushchairs. All of these inventions are distinguishable from the instant invention, in that in these inventions, the canopies are suspended a distance above the surface of the picnic tables, and the edges of the canopies are not secured to the table top. Thus, unlike the present invention, the prior art canopies do not provide protection from wind-propelled dirt and debris, nor from insects and scavenging birds.

Finally, U.S. Pat. No. 3,233,618 issued on Feb. 8, 1966, to Peter Ferrier discloses a picnic table shelter. The Ferrier invention is designed to be deployed around the picnic table and benches for protecting the picnickers as well, while they are using the picnic table. Hence, the Ferrier invention —a very large tent supported by the picnic table —serves a different function and is, therefore, not as easy to transport, assemble or use as the present invention.

Therefore, a need still exists for a picnic table covering which more fully protects food and drinks which are temporarily left on picnic tables. None of the above inventions and patents, taken either singly or in combination, is seen to describe the instant invention as claimed.

SUMMARY OF THE INVENTION

The present invention is a semicylindrical cover for a table, especially an outdoor picnic table, that may be placed over food and drink left on the table, for temporary protection while a family or other group leaves the table unattended. The cover protects the food and drink from the heat of the sun, wind, rain, falling leaves, bird droppings, insects or other pests. The invention includes a rectangular main portion that is constructed from a flexible waterproof material. The main portion is supported over the table by rigid, semicircular ribs which maintain the main portion in a curved shape. Semicircular end portions of flexible waterproof material are attached to the opposite ends of the main portion for additional protection of the ends of the picnic table. After positioning, the ends of clamps are passed through pairs of holes provided adjacent the side portions of the cover to clamp each side portion of the cover between a clamping member and a side of the picnic table. The ends of the clamps are biased towards each other to securely clamp the top and bottom surfaces of the picnic table.

Preferably, only the top section of the end portions of the cover should be sewn to the main portion of the cover, and the lower section of the end portions should be unattached, hanging freely. This enables a picnicker to roll up the lower section of one or both of the end portions for easily accessing objects resting on the covered picnic table. Additionally, the upper section of the end portion may be provided with a strap for holding the rolled up lower section. Also, hook and loop fasteners may be provided upon the lower section of the end portion and the main portion of the cover to secure the end portions thereagainst when unrolled.

The cover may be made of any suitable flexible waterproof material, including natural or synthetic fabrics, or plastic. The ribs may be made of any suitable material that is sufficiently rigid to support the cover, including wood, metal or plastic. The clamps may be made of any suitable resilient material, including metal or plastic. It is preferable that all parts of the invention be made of light weight materials, so that it will be easy to carry.

To assemble the invention, first the cover is unfolded. Then the cover and the rigid ribs are positioned over the table. Finally, clamping members are positioned over the side portions of the main cover adjacent the sides of the table. Clamps are passed around the clamping member, through the clamp hole pairs, and around the top and bottom surfaces of the picnic table to retain the cover in position.

Accordingly, it is a principal object of the invention to provide a convenient protective means for covering food, drink and any other items left on a picnic table.

It is a further object of the invention to provide a picnic table cover that may be easily folded up for storage and transportation.

Still another object of the invention is to provide a table cover which may be used in conjunction with variously dimensioned rectangular tables.

Still a further object of the invention is to provide means for easily accessing the covered objects.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a picnic table cover for protecting food and drinks from the heat of the sun, wind, rain, falling leaves, bird droppings, insects or other pests.

Figure 1:
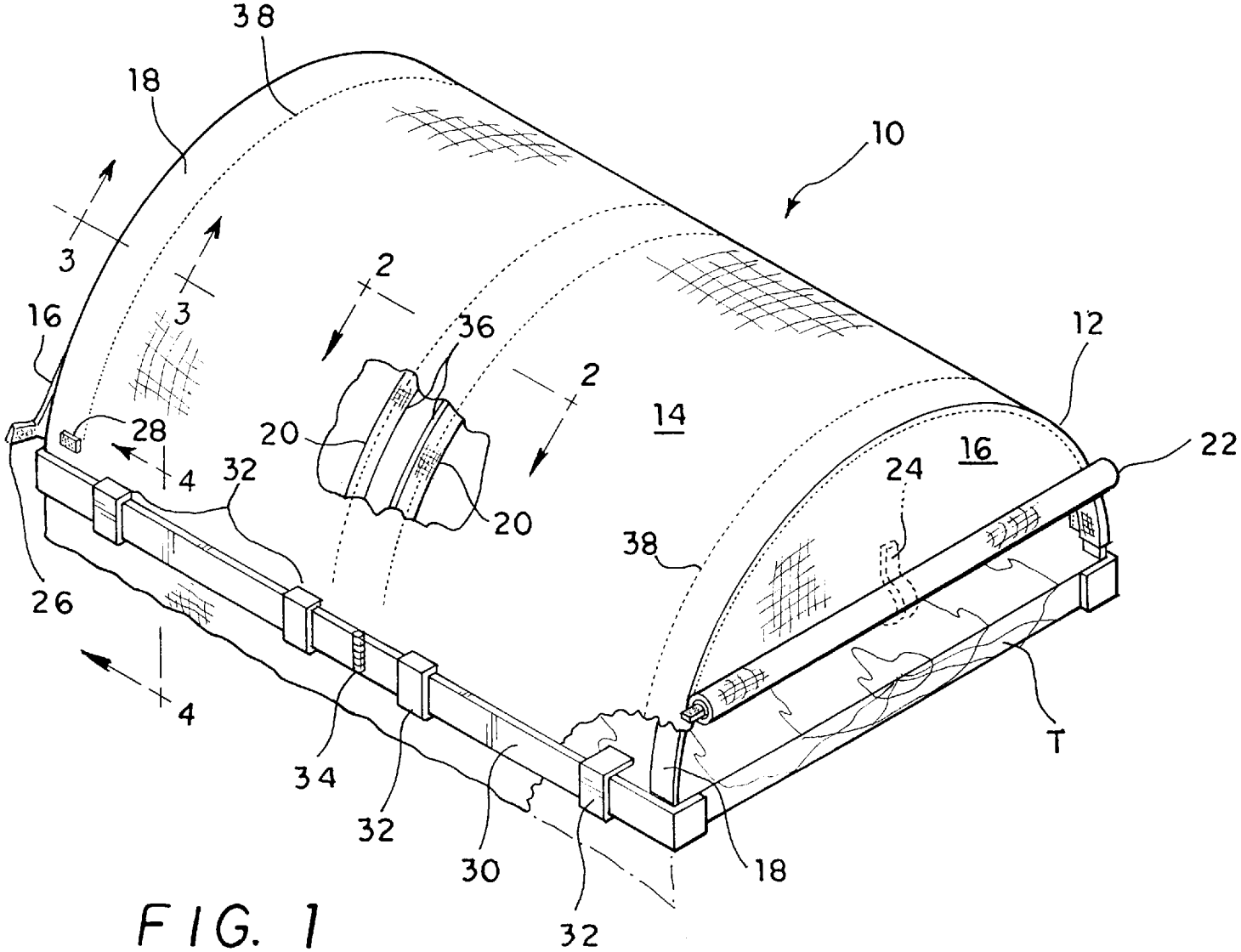
FIG. 1 is a perspective environmental view of the invention, positioned over a picnic table.

FIG. 1 is a perspective environmental view of the invention 10, depicting it being used to cover a picnic table T. The invention includes a cover 12 with a curved main portion 14 that goes over the top of the table T, and two semicircular end portions 16 that go over each end of the table T. Each edge 38 of the main portion 14 of the cover 12 is folded around one of the end ribs 18 and sewn to itself. Similarly, each middle rib 20 is positioned behind the main portion 14 of the cover 12, and a strip of cloth 36 is sewn to the cover 12 to enclose the rib 20.

The two end ribs 18 are placed on the opposite ends of the table T and support both the main portion 14 and the end portions 16 of the cover 12. The middle ribs 20 are placed on the table T between its opposite ends, and support only the main portion 14 of the cover 12. The lower part of each end portion 16 may be rolled up 22, and supported by a strap 24, to allow access to the table top T and items thereon without removing the cover 12. Only the upper parts of the end portions 16 are sewn to the main portion 14, but the edges of lower part of the end portions 16 may be removably attached to the adjacent edges of the main portion 14 by matingly engagable hook and loop fasteners 26 and 28.

To use the invention, first the cover 12 is unfolded. Then the cover 12 and its ribs are placed in position on the top of the table T. Finally the cover 12 is fastened to each of the long sides of the table top by clamping members 30, and a plurality of clamps 32. These steps may be performed in the reverse order to disassemble the invention for storage and transportation. Each clamping member 30 includes a pivot 34, such as a conventional hinge, by which the clamping member 30 may be folded in half, for easier carrying and storage.

Figure 2:
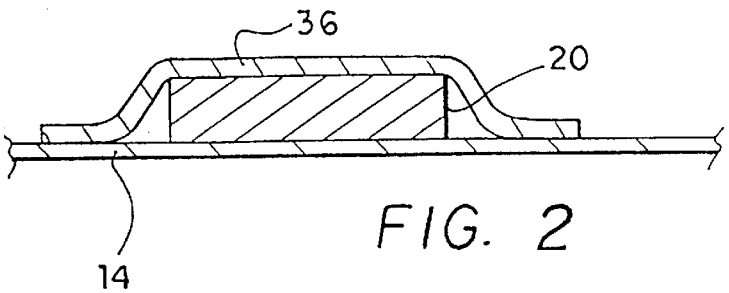
FIG. 2 is a cross-sectional view along line 2 —2 in FIG. 1, depicting the cover attached to a middle rib.

FIG. 2 is a cross-sectional view along line 2—2 in FIG. 1, depicting in greater detail how each middle rib 20 is attached to the main portion 14 of the cover 12. Specifically, a middle rib 20 is positioned behind the main portion 14 of the cover 12, and a strip of cloth 36 is sewn to the cover 12 to enclose the rib 20.

Figure 3:
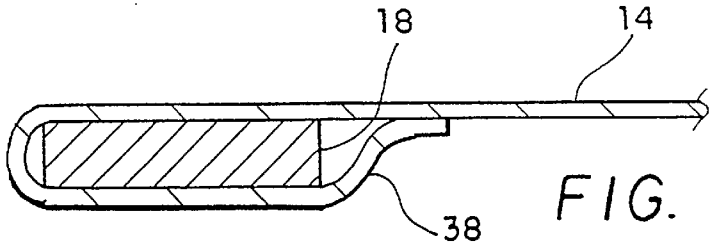
FIG. 3 is a cross-sectional partial view along line 3—3 in FIG. 1, depicting the cover attached to an end rib.

FIG. 3 is a cross-sectional view along line 3—3 in FIG. 1, depicting in greater detail how the cover 12 is attached to an end rib 18. Specifically, the edge 38 of the main portion 14 of the cover 12 folded over the rib 18 and sewn to itself.

Figure 4:
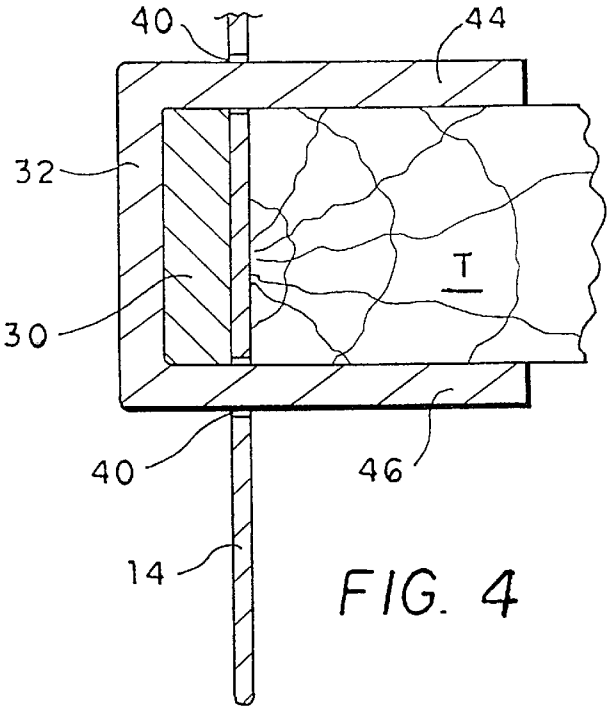
FIG. 4 is a cross-sectional view along line 4—4 in FIG. 1, depicting the cover clamped onto the table.

FIG. 4 is a cross-sectional view along line 4—4 in FIG. 1, depicting in greater detail how main portion 14 of the cover 12 is clamped onto the table T. Clamp 32 is integral with clamping member 30. Clamp 32 has an upper end 44 sized for passage through an upper clamping hole 40 in the cover 12, and a lower end 46 sized for passage through a lower clamping hole 42 in the cover 12. The ends 44,46 of the clamp 32 are biased towards each other for frictional clamping engagement of the upper and lower surfaces of the table T.

Figure 5:
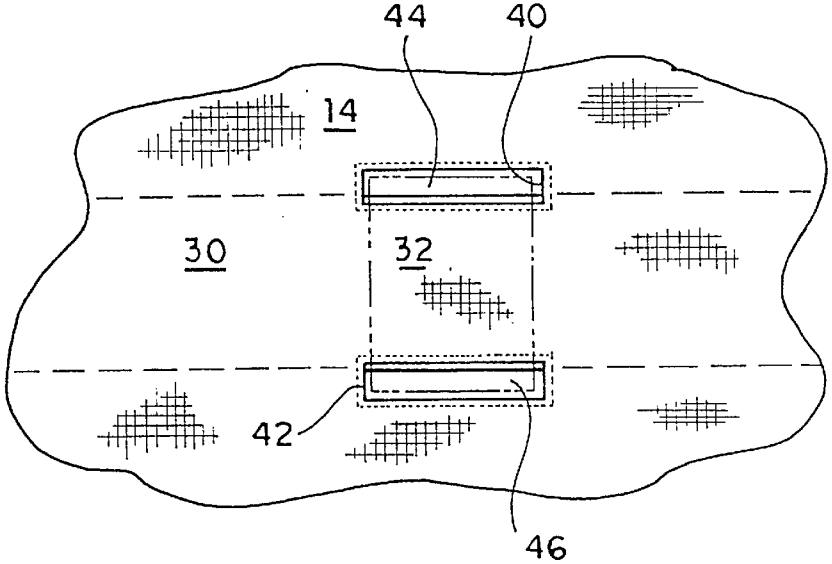
FIG. 5 is a detail front elevational view, depicting the cover clamped onto the table.

FIG. 5 is a detail front elevational view, depicting the main portion 14 of the cover 12 clamped onto the table T by a representative clamp 32. The clamp 32 has an upper end 44 sized for passage through an upper clamping hole 40 in the cover 12, and a lower end 46 sized for passage through a lower clamping hole 42 in the cover 12. Clamping member 30, which is depicted in phantom line, is integral with clamp 32.

It is to be understood that the present invention is not limited to the sole embodiment described above, but encompasses any and all embodiments within the scope of the following claims.

I claim:

1. A device for covering a table surface, comprising:

a cover constructed of a flexible sheet material dimensioned and configured for deployment over a table, the cover including a rectangular main portion having two opposing ends, two opposing sides, and a plurality of pairs of upper and lower clamping holes adjacent each of the two opposing sides, the cover further including two semicircular end portions each having a semicircular edge, each end portion attached to one of the opposing ends of the main portion along the semicircular edge;

a plurality of rigid, semicircular ribs having opposing rib ends and sized for placement of the opposing rib ends upon the table surface for supporting the cover over the table surface, whereby the unfolded, supported cover has a semicylindrical form as defined by the shape of the plurality of rigid, semicircular ribs;

two clamping members, each clamping member for securing one of the opposing sides of the main portion of the cover against one of the two opposing sides of the table surface; and a plurality of clamps sized for clamping each of the opposing sides of the main portion of the cover between one of the clamping members and one of the opposing sides of the table surface, each clamp having a lower end sized for passage through the lower clamping hole of one of the clamping hole pairs in the main portion of the cover, the clamp having an upper end sized for passage through the upper clamping hole of the clamping hole pair, the upper and lower ends of the clamps biased towards each other for frictional clamping to the upper and lower sides of the table surface.

2. The device for covering a table surface according to claim 1, wherein:

each of the semicircular end portions of the cover have an upper section adjacent the semicircular edge and a lower section adjacent the straight edge; and only each semicircular edge adjacent the upper section is sewn to one of the opposing end portions of the main portion of the cover, whereby the lower section of each end portion may be rolled up.

3. The device for covering a table surface according to claim 2, further comprising at least one strap attached each of the upper sections of the end portions for retaining the rolled up lower section.

4. The device for covering a table surface according to claim 2, further comprising lower end section securing means for securing each lower section of the unrolled end portions of the cover to the main portion.

5. The device for covering a table surface according to claim 4, wherein the lower end section securing means comprises mating components of a hook and loop fastener, each one of said mating components disposed in alignment with the other upon one of the lower section of the end portions and the main portion of the cover.

6. A device for covering a table surface according to claim 1, wherein each of the clamping members further comprises a central pivot for folding the clamping member in half when not in use.

7. The device for covering a table surface according to claim 1, wherein the cover is constructed of a waterproof material.

8. The device for covering a table surface according to claim 1, wherein the plurality of clamps comprise a first plurality of clamps integrally attached to one of the clamping members and a second plurality of clamps integrally attached to the second of the clamping members.

* * * * *